US008725027B2

(12) United States Patent
Goto

(10) Patent No.: US 8,725,027 B2
(45) Date of Patent: May 13, 2014

(54) IMAGE FORMING DEVICE

(75) Inventor: Yuji Goto, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 220 days.

(21) Appl. No.: 13/072,846

(22) Filed: Mar. 28, 2011

(65) Prior Publication Data

US 2012/0076527 A1 Mar. 29, 2012

(30) Foreign Application Priority Data

Sep. 29, 2010 (JP) ..... 2010-219208

(51) Int. Cl.
*G03G 21/00* (2006.01)

(52) U.S. Cl.
USPC ..... 399/98; 399/99; 399/110; 399/301

(58) Field of Classification Search
USPC ..... 399/98, 99, 110, 301
See application file for complete search history.

(56) References Cited

U.S. PATENT DOCUMENTS

| | | | | |
|---|---|---|---|---|
| 5,978,626 | A | 11/1999 | Nagamine et al. | |
| 6,038,417 | A | 3/2000 | Nagamine et al. | |
| 6,219,508 | B1 | 4/2001 | Nagatomi et al. | |
| 7,460,804 | B2 | 12/2008 | Onose et al. | |
| 7,899,355 | B2 | 3/2011 | Sakuma | |
| 7,933,531 | B2 | 4/2011 | Hayakawa | |
| 8,532,521 | B2 | 9/2013 | Sakuma | |
| 2005/0163518 | A1 * | 7/2005 | Onose et al. | 399/49 |
| 2006/0171727 | A1 | 8/2006 | Inui et al. | |
| 2009/0169233 | A1 | 7/2009 | Hayakawa | |
| 2009/0285593 | A1 * | 11/2009 | Sakuma | 399/111 |
| 2010/0080614 | A1 | 4/2010 | Yamaguchi et al. | |
| 2012/0328348 | A1 | 12/2012 | Sakuma | |
| 2014/0003835 | A1 | 1/2014 | Sakuma | |

FOREIGN PATENT DOCUMENTS

| | | |
|---|---|---|
| CN | 101581893 A | 11/2009 |
| JP | 04-159564 | 6/1992 |
| JP | 10-115962 | 5/1998 |
| JP | 11-153893 | 6/1999 |
| JP | 2002-031919 | 1/2002 |
| JP | 2002-131997 | 5/2002 |
| JP | 2002-268480 | 9/2002 |
| JP | 2006-215203 | 8/2006 |
| JP | 2009-157206 | 7/2009 |
| JP | 2009-258245 | 11/2009 |
| JP | 2010-102355 | 5/2010 |

OTHER PUBLICATIONS

Notice of Allowance for corresponding Japanese Patent Application No. 2010-219208 dtd. Jul. 24, 2012.
Office Action issued in corresponding Chinese Application No. 201110085106.2 mailed Nov. 28, 2013.

* cited by examiner

*Primary Examiner* — Ryan Walsh
(74) *Attorney, Agent, or Firm* — Banner & Witcoff, Ltd.

(57) ABSTRACT

An image forming device is provided, which includes an interlocking mechanism that causes a cleaning unit to clean with a cleaning surface thereof a detection surface of a detection sensor for reading each detection pattern formed on an outer surface of a sheet-feeding endless belt, in conjunction with movement of a drawer, which holds a plurality of process cartridges, between an attachment position where a photoconductive drum included in each process cartridge faces an up-facing side of the outer surface of the endless belt and a replacement position where at least one of the process cartridges is outside a main body housing of the image forming device.

4 Claims, 10 Drawing Sheets

IMAGE FORMING DEVICE

CROSS-REFERENCE TO RELATED APPLICATION

This application claims priority under 35 U.S.C. §119 from Japanese Patent Application No. 2010-219208 filed on Sep. 29, 2010. The entire subject matter of the application is incorporated herein by reference.

BACKGROUND

1. Technical Field

The following description relates to one or more image forming devices that include a belt unit having an endless belt, a plurality of process cartridges, arranged along the belt unit, each of which contains therein a specific color of recording agent used for color image formation, and a detection sensor configured to optically read a detection pattern formed on the endless belt with each recording agent.

2. Related Art

So far, as an image forming device that forms a color image, an image forming device has been known that includes a belt unit having an endless belt and a plurality of process cartridges, arranged along the belt unit, each of which contains therein toner used for color image formation.

The known image forming device has the plurality of process cartridges arranged on a surface of the endless belt in a tandem manner, and each of the process cartridges contains therein toner of a specific one of the colors, black (K), yellow (Y), magenta (M), and cyan (C). Further, the known image forming device forms a color image on a recording medium while sequentially transferring different color toner images in a superimposed manner. Accordingly, in order to assure favorable image quality, the known image forming device needs to control with a high accuracy a position where a toner image is superimposed on another toner image and a density of each toner image.

In consideration of the aforementioned regards, the known image forming device is configured to form a detection pattern with each color of toner on the endless belt and optically detect each detection pattern with an optical sensor which is disposed such that a detection surface thereof faces the surface of the endless belt. Therefore, by reading each detection pattern with the optical sensor, the known image forming device can appropriately correct the position where a toner image is to be superimposed on another toner image and the density of each toner image, and thus form a user-desired image of favorable image quality.

SUMMARY

In the known image forming device, a certain level of detection accuracy for detecting each detection pattern by the optical sensor is required to correct a positional deviation and an inadequate density of each toner image. As described above, since the detection surface of the optical sensor faces the endless belt, when toner used for the formation of the image or the detection pattern image is splashed, the detection surface is likely to be contaminated by the splashed toner. Such a contaminated detection surface might lead to a lowered level of detection accuracy for detection of the detection patterns and in a lowered level of quality of the image formed by the image forming device.

Accordingly, in order to assure favorable quality of the image formed by the image forming device, it is required to keep the detection surface of the optical sensor clean. In this respect, a user may be required to clean the detection surface of the optical sensor on user's own. In this case, however, favorable image quality might not certainly be assured as a moment to clean the detection surface is determined by the user. Further, the user could not clean the detection surface on user's own due to a problem concerning a positional relationship between the optical sensor and a different component.

Aspects of the present invention are advantageous to provide one or more improved techniques for an image forming device having process cartridges and an endless belt, which techniques make it possible to keep clean a detection surface of a detection sensor for reading each detection pattern formed on the endless belt.

According to aspects of the present invention, an image forming device is provided, which includes a main body housing, a plurality of process cartridges each of which accommodates recording agent of a specific one of colors used for image formation, a plurality of photoconductive drums each of which is configured such that an electrostatic latent image, to be developed with the recording agent of a specific one of the colors, is formed thereon, a belt unit including an endless belt wound around a pair of rollers inside the main body housing, the endless belt being configured such that an up-facing side of an outer surface thereof extends and travels in a predetermined direction, a drawer configured to hold the process cartridges and the photoconductive drums arranged along the predetermined direction above the belt unit, the drawer being movable between an attachment position where each photoconductive drum faces the up-facing side of the outer surface of the endless belt and a replacement position where at least one of the process cartridges is outside the main body housing, a pattern forming unit configured to form, on the up-facing side of the outer surface of the endless belt, a detection pattern corresponding to each color of the recording agent used for image formation, a detection sensor comprising a detection surface that faces the outer surface of the endless belt, the detection sensor being configured to read, through the detection surface, each detection pattern formed on the outer surface of the endless belt, a cleaning unit including a cleaning surface configured to be able to contact and clean the detection surface of the detection sensor, and an interlocking mechanism that causes the cleaning unit to clean the detection surface of the detection sensor with the cleaning surface in conjunction with movement of the drawer between the attachment position and the replacement position.

BRIEF DESCRIPTION OF THE ACCOMPANYING DRAWINGS

Figure 5:
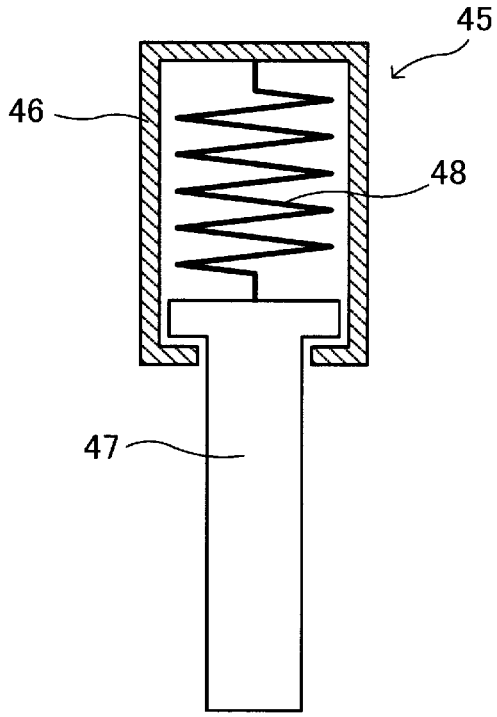

FIG. 5 schematically shows a configuration of an operating member provided to the drawer in the first embodiment according to one or more aspects of the present invention.

Figure 6:
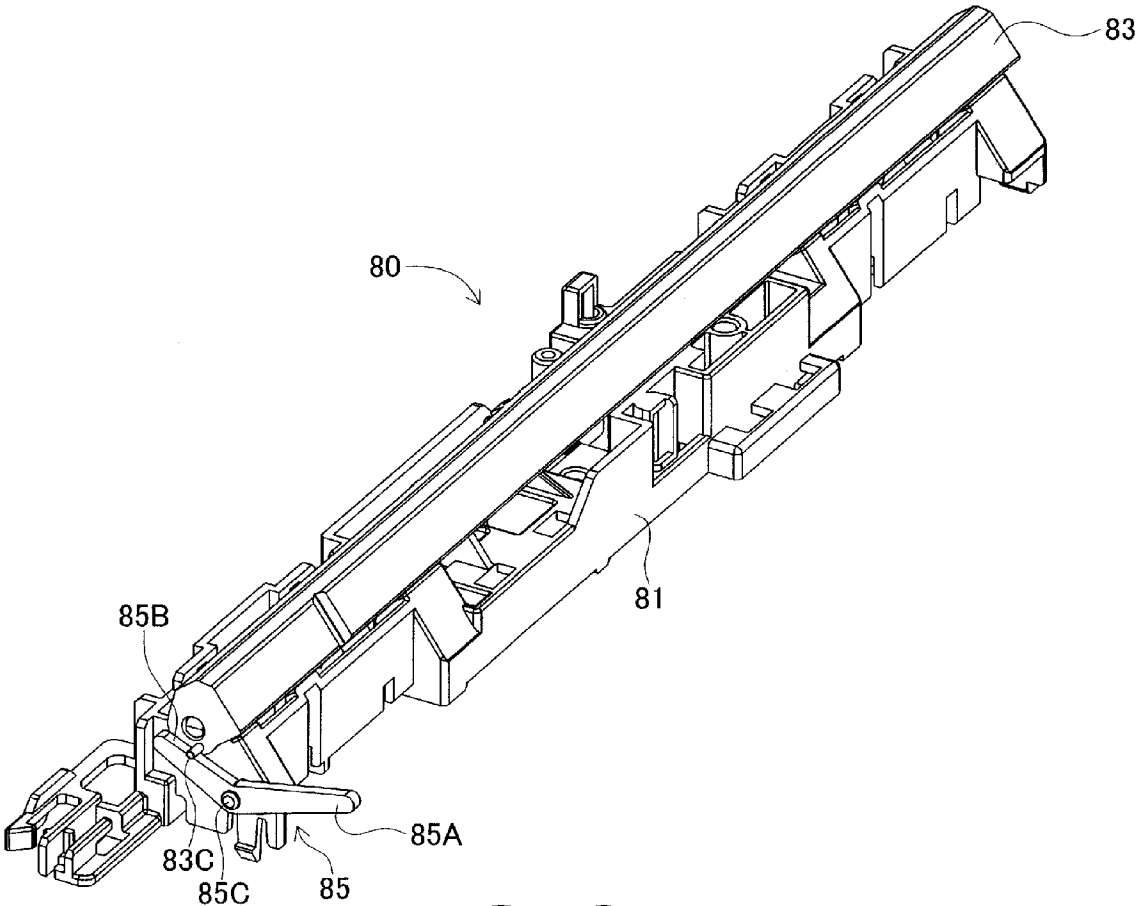
Figure 7:
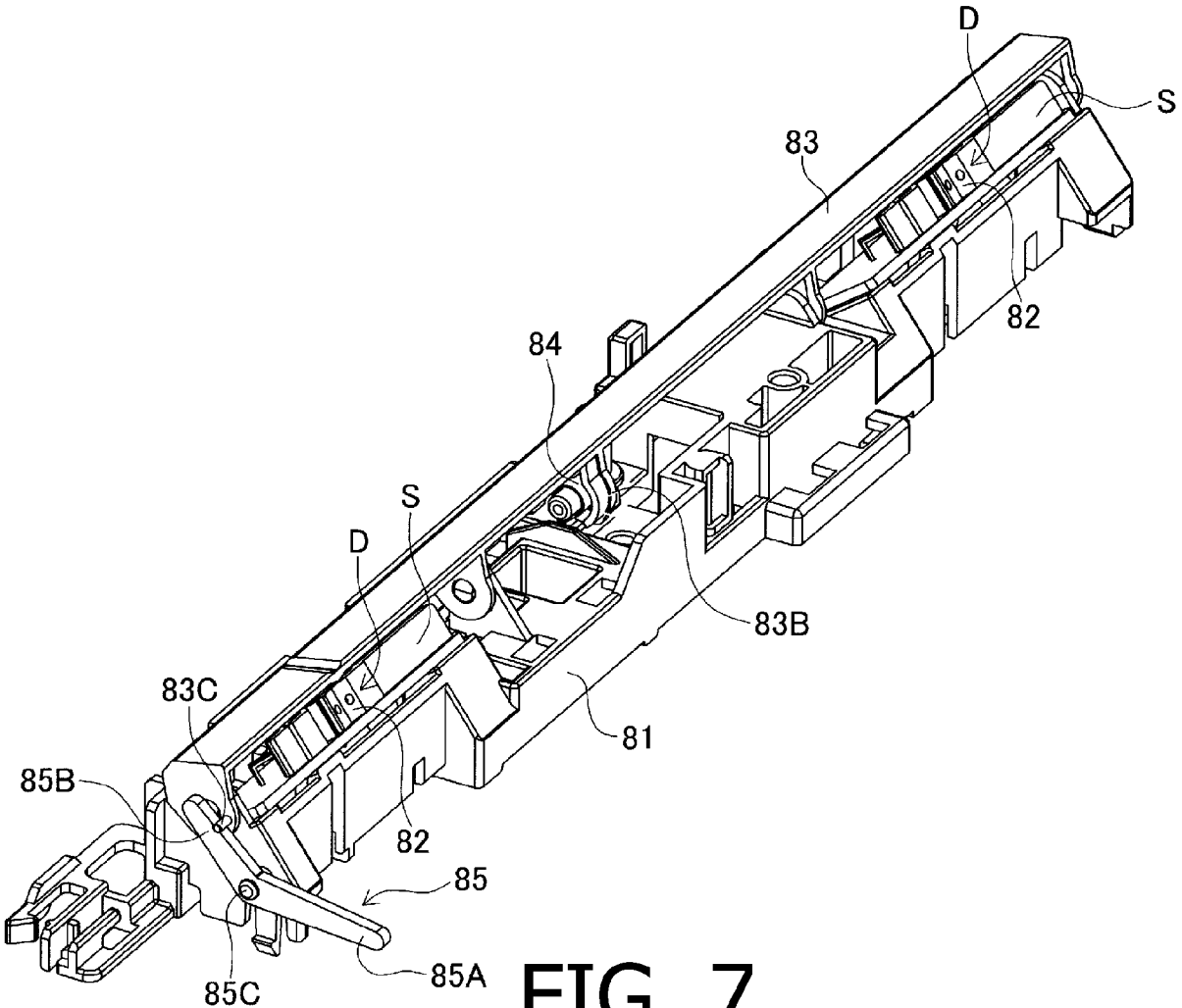

FIGS. 6 and 7 are perspective views showing an external configuration of a registration sensor unit in the first embodiment according to one or more aspects of the present invention.

Figure 8A:
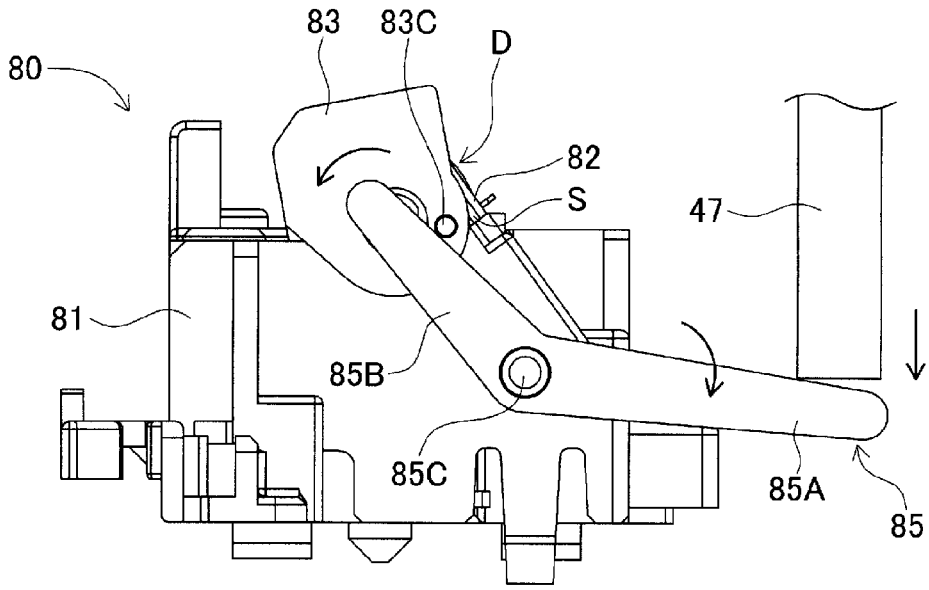
Figure 8B:
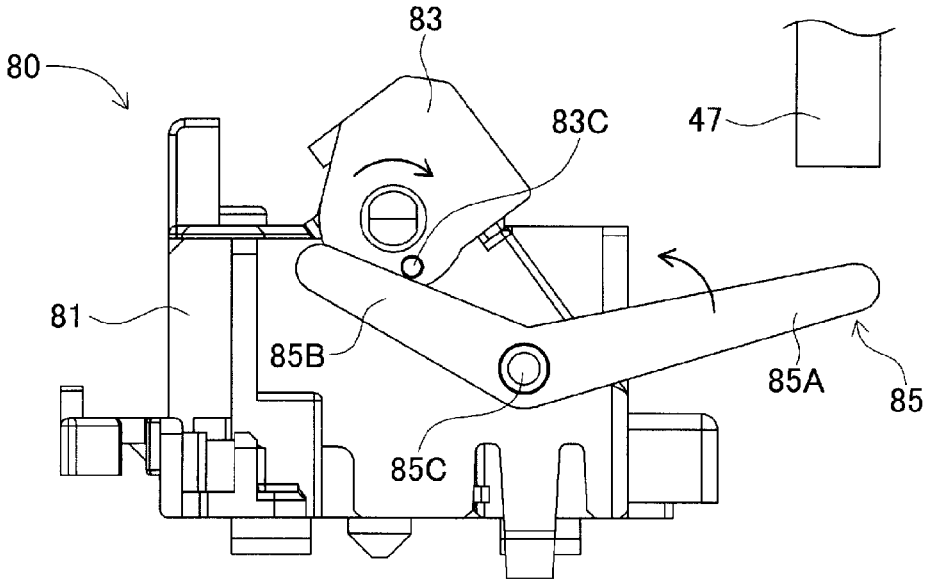

FIGS. 8A and 8B illustrate an operation of a cover member in the registration sensor unit in the first embodiment according to one or more aspects of the present invention.

Figure 9A:
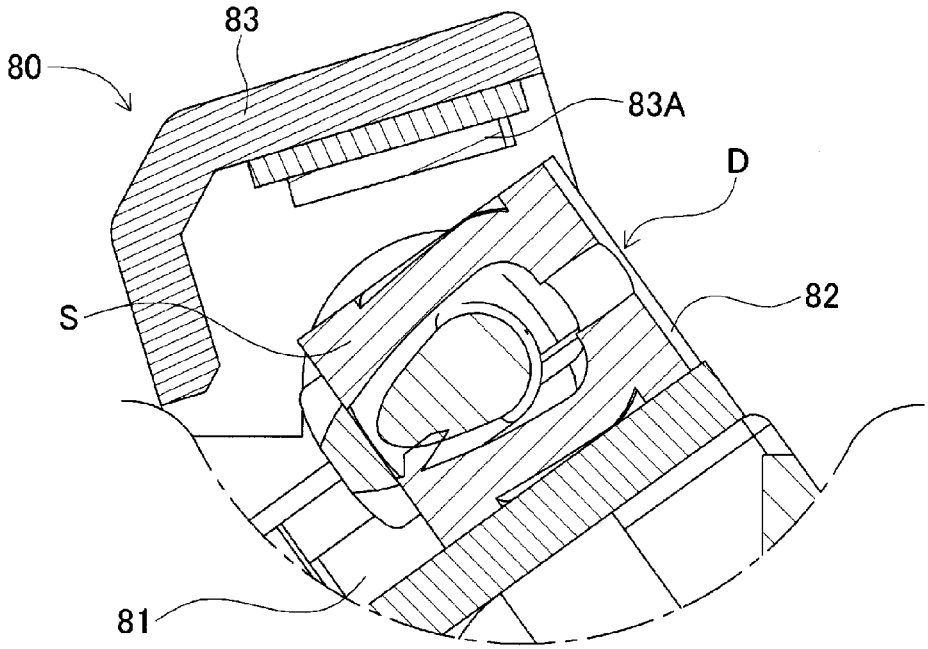
Figure 9B:
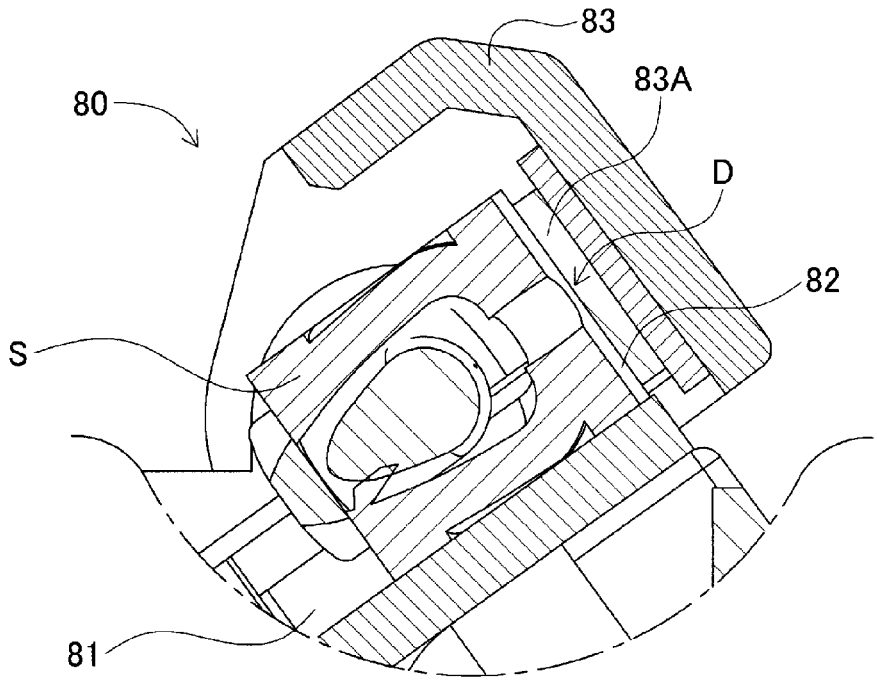

FIGS. 9A and 9B illustrate an operation of cleaning a detection surface in the registration sensor unit in the first embodiment according to one or more aspects of the present invention.

Figure 10A:
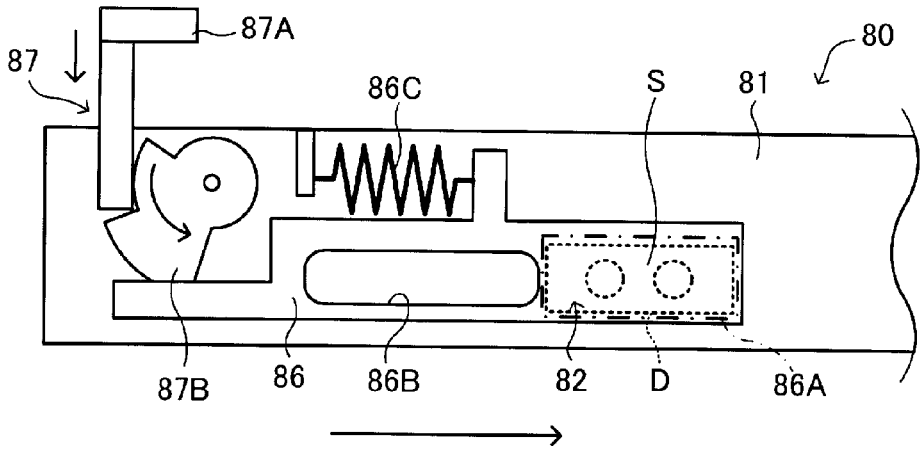
Figure 10B:
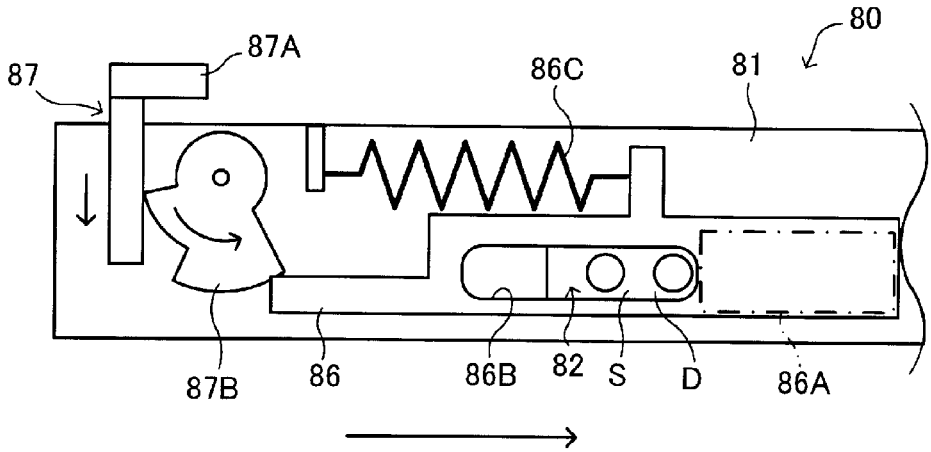
Figure 10C:
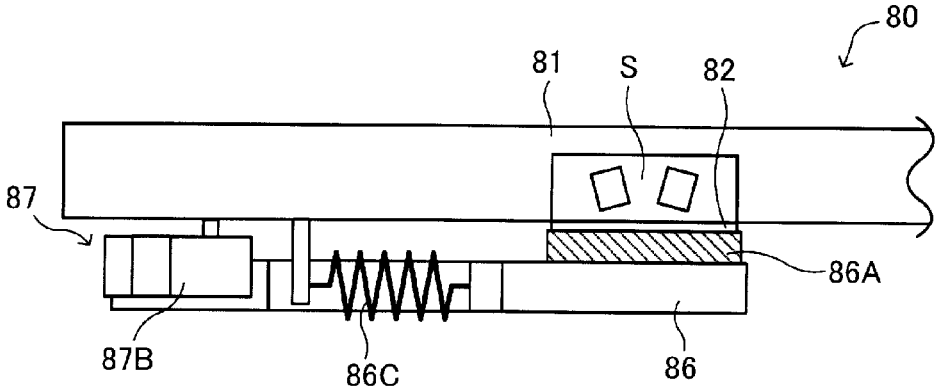

FIGS. 10A to 10C illustrate an operation concerning cleaning of the detection surface in a registration sensor unit in a second embodiment according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect.

First Embodiment

Hereinafter, a laser printer 1 of a first embodiment according to aspects of the present invention will be described with reference to FIGS. 1 to 4. In the following description, an up-to-down direction (i.e., the vertical direction) and a front-to-rear direction (and a left-to-right direction) of the laser printer 1 will be defined as depicted in the relevant drawings for the sake of easy understanding of a relative positional relationship among elements included in the laser printer 1. The laser printer 1 is a color laser printer configured to form a multicolor image on a sheet P using an electrophotographic technique.

Figure 1:
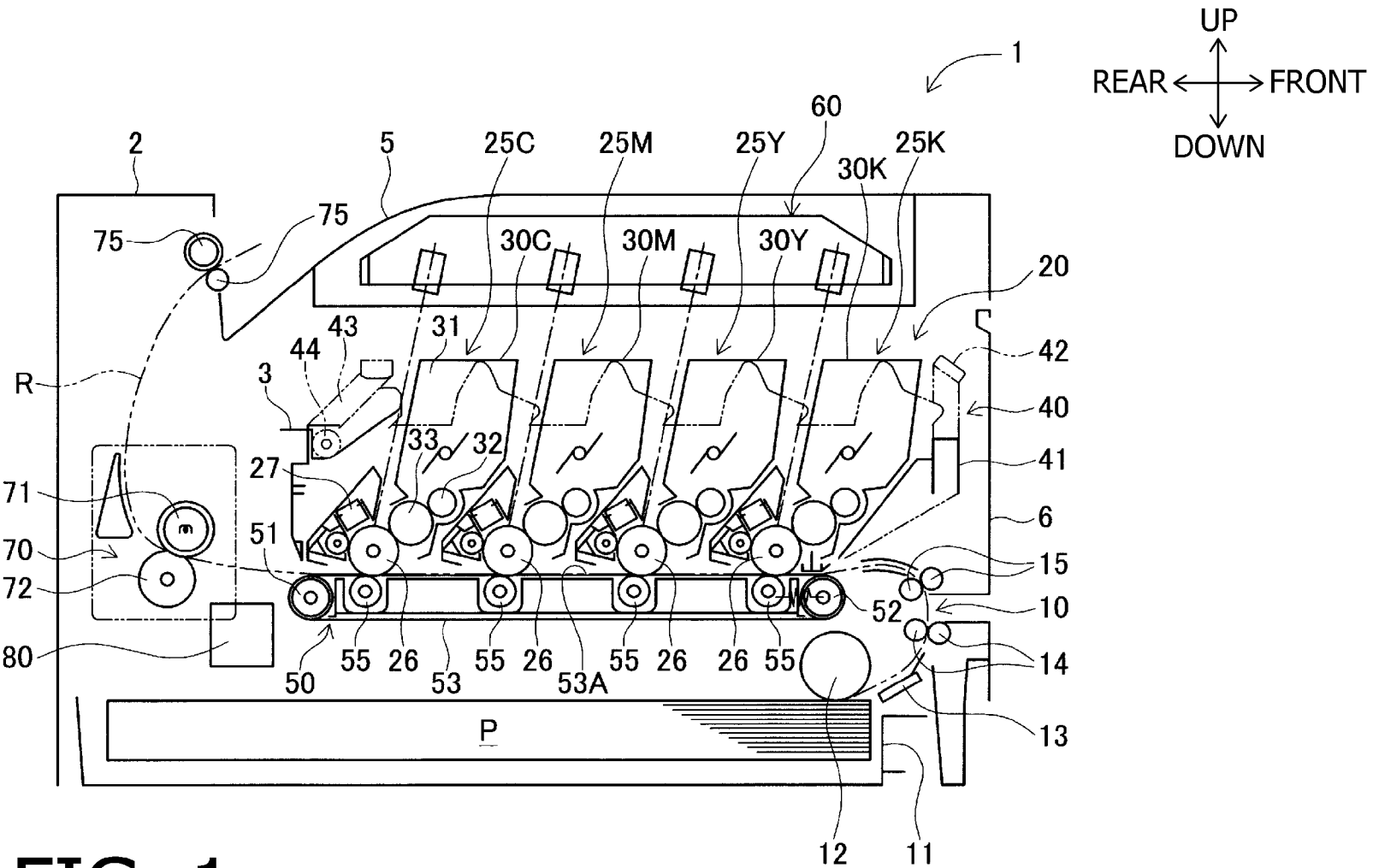
FIG. 1 is a cross-sectional side view schematically showing a configuration of a laser printer in a first embodiment according to one or more aspects of the present invention.

As shown in FIG. 1, the laser printer 1 includes a substantially box-shaped main body housing 2. Further, the laser printer 1 includes a feeding unit 10, an image forming unit 20, a conveying unit 50, a scanning unit 60, a fixing unit 70, and a registration sensor unit 80, all of which are housed in the main body housing 2. The image forming unit 20 is disposed substantially in a center of an internal space of the main body housing 2.

Figure 2:
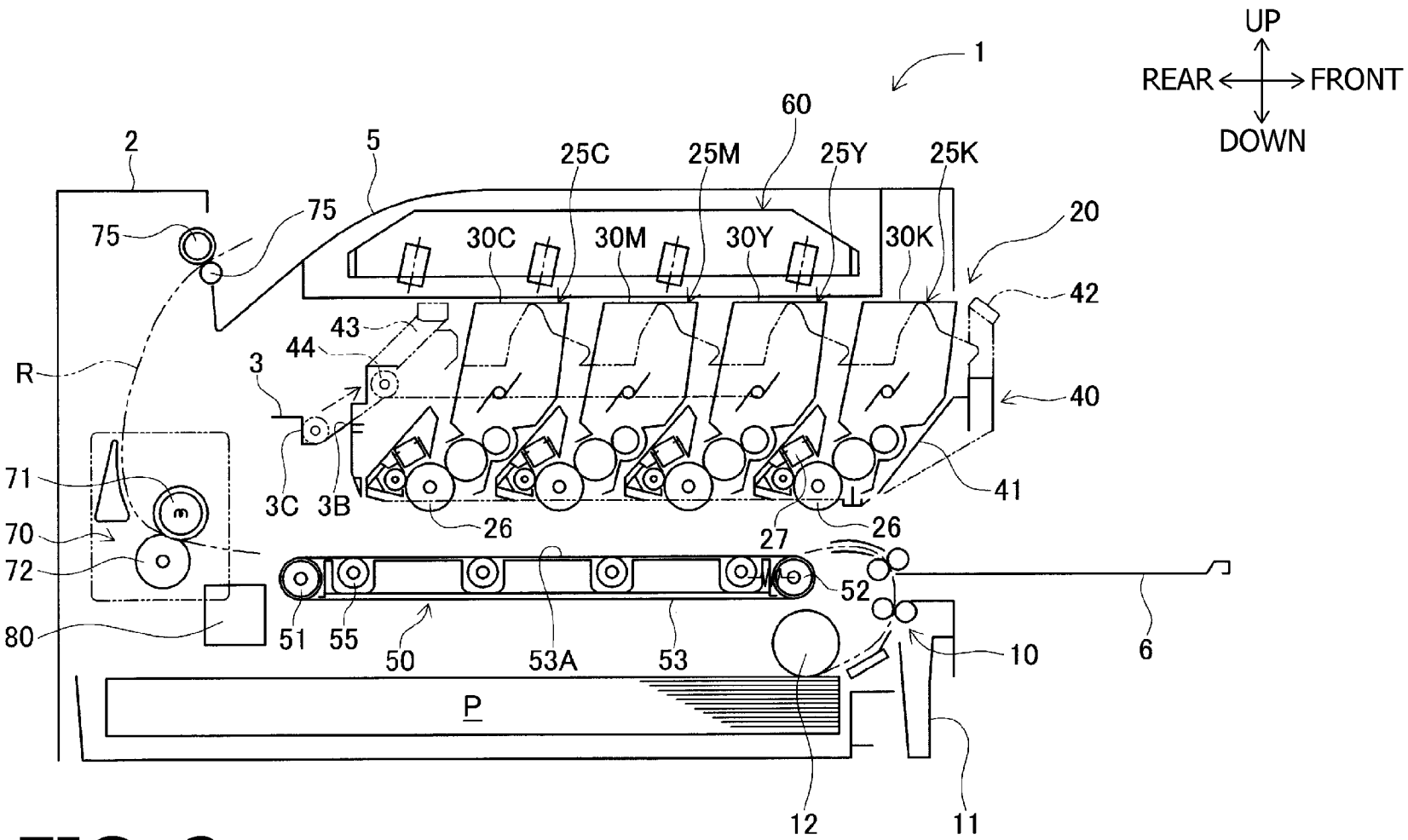
FIG. 2 is a cross-sectional side view illustrating the laser printer in which a drawer moves between an attachment position and a replacement position in the first embodiment according to one or more aspects of the present invention.
Figure 3:
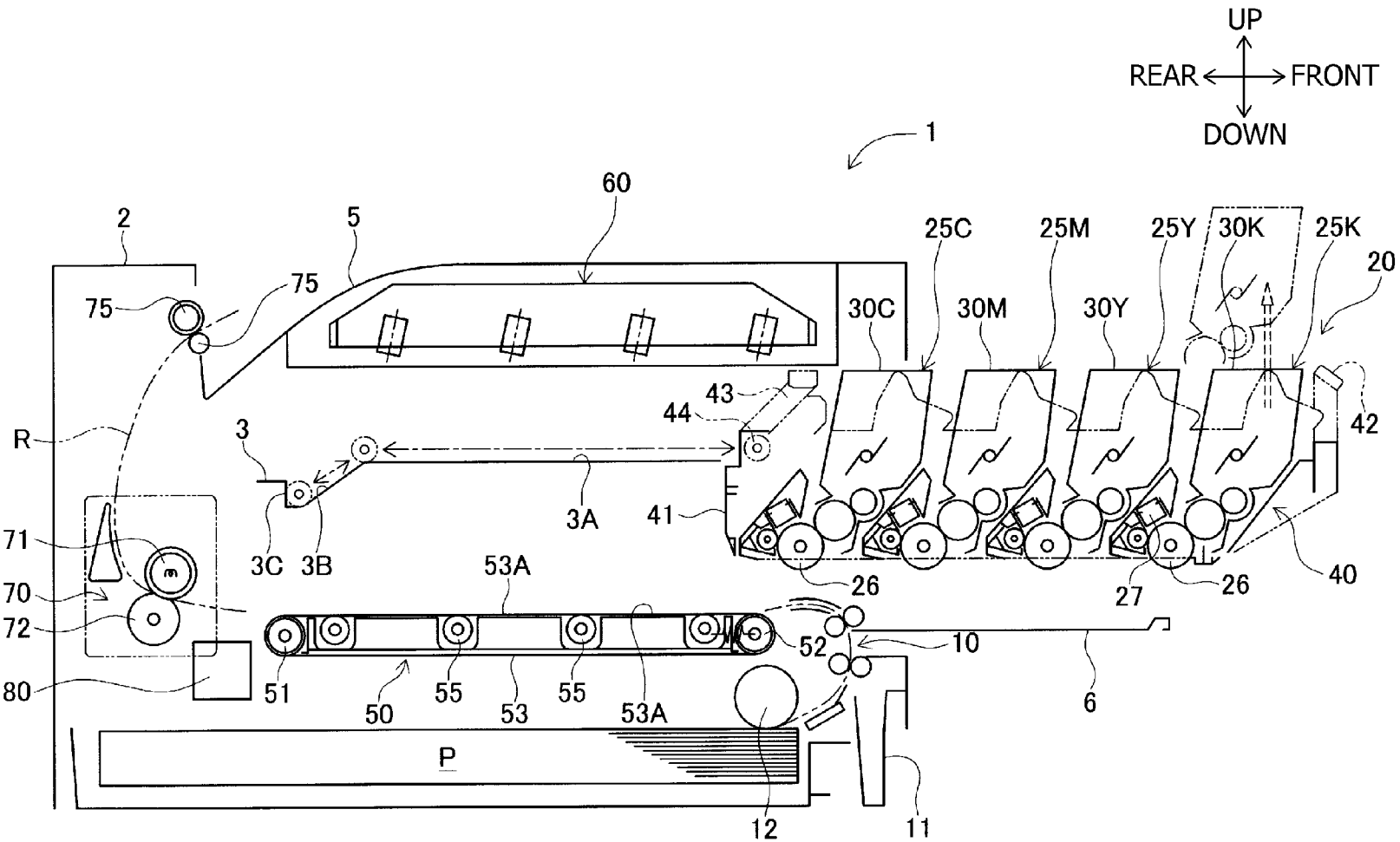
FIG. 3 is a cross-sectional side view showing the laser printer in which the drawer is in the replacement position in the first embodiment according to one or more aspects of the present invention.

On an inner side face of each side of the main body housing 2 in the left-to-right direction (i.e., on each inner side face of the far and near sides of the main body housing 2 in the direction perpendicular to a plane of FIGS. 1 to 3), a drawer guide 3 is formed to protrude horizontally toward the inside of the main body housing 2. The drawer guides 3 guide a drawer 40 (included in the image forming unit 20) when the drawer 40 is moved between an attachment position (see FIG. 1) and a replacement position (see FIG. 3).

As depicted in FIGS. 2 and 3, each drawer guide 3 includes a first guide surface 3A, a second guide surface 3B, and a stopper surface 3C. The first guide surface 3A is horizontal in both the front-to-rear direction and the left-to-right direction of the laser printer 1. Further, the first guide surface 3A is formed as a flat plane extending from a position near a front cover 6 toward a rear side in an elongated manner. The second guide surface 3B is horizontal in the left-to-right direction, and formed as a flat plane extending obliquely downward to a rear side of the laser printer 1. A front end of the second guide surface 3B is continuous with a rear end of the first guide surface 3A. With the first guide surface 3A and the second guide surface 3B, a bent guide surface is configured. The stopper surface 3C is horizontal in the left-to-right direction of the laser printer 1, and extends upward from a rear end of the second guide surface 3B. The stopper surface 3C has a role for positioning the drawer 40, moved along the drawer guides 3, in a predetermined attachment position (see FIG. 1).

A catch tray 5 is formed above the main body housing 2, such that the sheet P, with an image formed thereon by the image forming unit 20, is ejected thereonto by ejection rollers 75. The catch tray 5 is loaded with ejected sheets P stacked thereon. Further, the front cover 6 is provided at a front face of the main body housing 2, to be open and closed while turning around a lower end of the front cover 6. As illustrated in FIGS. 2 and 3, the front cover 6 is opened when the drawer 40 is to be pulled out of the main body housing 2.

Subsequently, an explanation will be provided about the feeding unit 10 of the laser printer 1. The feeding unit 10 is configured to feed the sheet P to the image forming unit 20. The feeding unit 10 includes a feed tray 11, a pickup roller 12, a separation pad 13, feed rollers 14, and registration rollers 15.

The feed tray 11 is detachably attached under the main body housing 2 and configured to accommodate a stack of sheets P. The pickup roller 12 is rotatably disposed in a position above a front end of the feed tray 11 and configured to pick up and feed a sheet P from the feed tray 11 toward the image forming unit 20. The separation pad 13 is configured to provide the sheet P fed by the pickup roller 12 with a predetermined feeding resistance, and to separate and feed the sheet P on a sheet-by-sheet basis.

As shown in FIG. 1, the sheet P fed from the feed tray 11 is conveyed toward the catch tray 5 along a feeding route R. Namely, a feeding direction in which the sheet P is fed in the laser printer 1 is a direction extending from the feed tray 11 to the catch tray 5 along the feeding route R.

Two feed rollers 14 are rotatably disposed downstream relative to the separation pad 13 in the feeding direction. The feed rollers 14 provide a feeding force to the sheet P to be conveyed to the image forming unit 20 while bent substantially in a U-shape along the feeding route R.

Further, two registration rollers 15 are rotatably disposed downstream relative to the feed rollers 14 in the feeding direction. The registration rollers 15 are configured to contact a leading end of the sheet P fed by the feed rollers 14 and carry out skew correction for the sheet P, and then feed the sheet P further to the image forming unit 20.

Subsequently, the image forming unit 20 of the laser printer 1 will be described. The image forming unit 20 is disposed substantially in a center of an internal space of the main body housing 2, and configured to form a color image on the sheet P fed by the feeding unit 10. The image forming unit 20, which employs a direct tandem method, includes a plurality of process cartridges 25K, 25Y, 25M, and 25C and the drawer 40.

The process cartridge 25K is used to form a black image with toner of black (K). The process cartridge 25Y is used to form a yellow image with toner of yellow (Y). The process cartridge 25M is used to form a magenta image with toner of magenta (M). The process cartridge 25C is used to form a cyan image with toner of cyan (C).

Further, the process cartridges 25K, 25Y, 25M, and 25C are arranged in the drawer 40 in the aforementioned order along a direction from a front side to a rear side of the drawer 40.

Next, an explanation will be provided about the configurations of the process cartridges 25K, 25Y, 25M, and 25C. The process cartridges 25K, 25Y, 25M, and 25C use respective different colors of toner. However, in the other respects, the process cartridges 25K, 25Y, 25M, and 25C are configured in the same fashion. Accordingly, in the following description, each of the process cartridges 25K, 25Y, 25M, and 25C will be referred to as a "process cartridge 25" in a generic manner.

The process cartridge 25 includes a known photoconductive drum 26, an electrification device 27, and a toner cartridge 30. On the photoconductive drum 26, an electrostatic latent image corresponding to a toner color of the process cartridge 25 is formed by the below-mentioned scanning unit 60. Then, when toner is supplied to the electrostatic latent image, a toner image is formed on the photoconductive drum 26. The photoconductive drum 26 is disposed such that a part thereof protrudes downward from a lower end of the drawer 40 and contacts a surface of a conveying belt 53 of the below-mentioned conveying unit 50. The electrification device 27 is configured to charge the surface of the photoconductive drum 26 evenly and positively when the electrostatic latent image is formed on the surface of the photoconductive drum 26. The photoconductive drum 26 and the electrification device 27 are integrally supported by and fixed to the drawer 40, and can be replaced as expendable parts together with the drawer 40.

The toner cartridge 30 includes a toner container 31, a supply roller 32, and a development roller 33. The toner container 31 contains therein toner of a color corresponding to the process cartridge 25. The supply roller 32 supplies the toner contained in the toner container 31 to the development roller 33. The development roller 33 adjusts (regulates) the thickness of the toner supplied by the supply roller 32 to a predetermined thickness, with a layer thickness regulating blade. Further, the development roller 33 carries the toner with the thickness thereof adjusted and supplies the toner to the surface of the photoconductive drum 26.

It is noted that the "toner cartridge 30" is a generic term that represents each of four toner cartridges 30K, 30Y, 30M, and 30C. For example, the toner cartridge 30 included in the process cartridge 25K is the toner cartridge 30K with black toner contained in the toner container 31 thereof. In the same manner, the toner cartridges 30Y, 30M, and 30C correspond to the process cartridges 25Y, 25M, and 25C, respectively.

Next, an explanation will be provided about the drawer 40 included in the image forming unit 20 with reference to FIGS. 1 to 4. The drawer 40 is configured to support the process cartridges 25K, 25Y, 25M, and 25C arranged therein and to be drawn from a predetermined attachment position (see FIG. 1) in the main body housing 2.

The drawer 40 includes a drawer frame 41, a front handle 42, a rear handle 43, and cam followers 44. The drawer frame 41, which constitutes a main body of the drawer 40, is formed in a box shape with an open upper side and an open lower side. The front handle 42 is firmly attached to the drawer frame 41 at an upper front side of the drawer 40. The front handle 42 is gripped by a user who moves the drawer 40. The rear handle 43 is firmly attached to the drawer frame 41 at an upper rear side of the drawer 40. The rear handle 43 is gripped by the user who moves the drawer 40.

The cam follower 44 is rotatably supported to protrude horizontally outward in the left-to-right direction (toward a near side and a far side in the direction perpendicular to the plane of FIG. 2), in a predetermined upper rear position on each side face of the drawer frame 41 in the left-to-right direction. Each cam follower 44 is configured to contact an upper face of a corresponding one of the drawer guides 3 and guide the drawer 40 along the drawer guide 3 when the drawer 40 is moved. It is noted that the cam followers 44 provided on both side faces of the drawer frame 41 in the left-to-right direction have their respective centers of axes on the same horizontal line.

Figure 4:
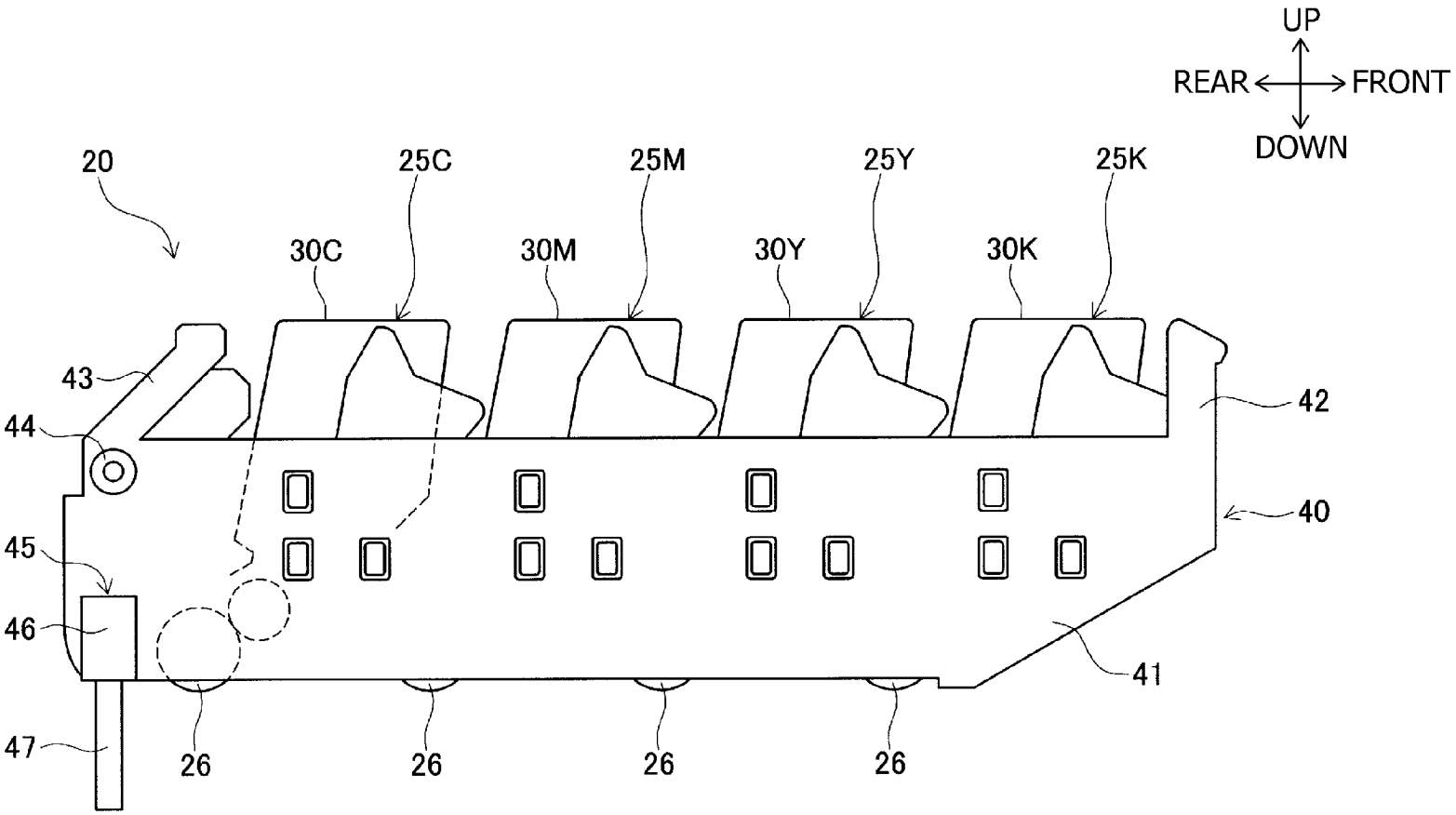
FIG. 4 is a side view showing a configuration of the drawer in the first embodiment according to one or more aspects of the present invention.

As shown in FIG. 4, the drawer 40 has an operating member 45 at a lower rear end on a right side face (a near side face in FIG. 3) of the drawer frame 41. The operating member 45 contributes to cleaning of a detection surface D of each registration sensor S in cooperation with a part of a below-mentioned registration sensor unit 80. As illustrated in FIG. 5, the operating member 45 includes a case 46, a contact member 47, and a coil spring 48. The case 46 is formed in a box shape having a through-hole on a lower surface, at a lower rear end of a right side face (a near side face in FIG. 4) of the drawer frame 41. The contact member 47 and the coil spring 48 are housed inside the case 46. The contact member 47 is formed in a pillar shape as high as a distance between a lower end of the drawer 40 at the time when the drawer 40 is located in the attachment position and a position near the registration sensor unit 80. Accordingly, the contact member 47 contacts a part (a below-mentioned interlocking member) of the registration sensor unit 80 when the drawer 40 is located in the attachment position. The coil spring 48 is disposed in a position higher than an upper surface of the contact member 47 in the case 46 and configured to provide a downward biasing force to the contact member 47.

Next, an explanation will be provided about the conveying unit 50 of the laser printer 1. The conveying unit 50 is configured to form a color image on the sheet P in cooperation with the image forming unit 20 while conveying the sheet P fed by the feeding unit 10 toward the catch tray 5. The conveying unit 50 is disposed in a position that is above the feeding unit 10 and under the image forming unit 20. As depicted in FIG. 1, the conveying unit 50 includes a driving roller 51, a driven roller 52, a conveying belt 53, and a plurality of transfer rollers 55.

The conveying belt 53 is a looped endless belt wound around the pair of the driving roller 51 disposed at a lower rear end of the image forming unit 20 and the driven roller 52 disposed at a lower front end of the image forming unit 20. The driving roller 51 is driven to rotate in synchronization with the registration rollers 15 and revolve the conveying belt 53 in a predetermined direction. An upper-facing outer surface of the conveying belt 53, which extends substantially in the horizontal direction beneath the image forming unit 20, constitutes a sheet conveying surface 53A that conveys the sheet P along the feeding route R while contacting a down-facing side of the sheet P.

Each transfer roller 55 contacts a down-facing side opposite to the sheet conveying surface 53A in a position to face a corresponding one of the photoconductive drums 26 across the sheet conveying surface 53A. When a transfer voltage is applied to each transfer roller 55 at a predetermined moment, each transfer roller 55 transfers the toner image carried on the surface of the photoconductive drum 26 onto the sheet P being conveyed on the sheet conveying surface 53A. Further, the conveying belt 53, made of electrically conductive rubber, is charged by the transfer voltage applied to each transfer roller 55. Thereby, the conveying belt 53 conveys the sheet P along the feeding route R, with the sheet P attracted to the sheet conveying surface 53A by an electrostatic force.

Subsequently, the scanning unit 60 of the laser printer 1 will be described. The scanning unit 60 is disposed in a top area inside the main body housing 2. The scanning unit 60 includes, for each toner color, a laser source, a polygon mirror, an fθ lens, and reflection mirrors. The scanning unit 60 forms an electrostatic latent image (to be developed with toner of a corresponding one of the colors) on each photoconductive drum 26 of the image forming unit 20. Specifically, a laser beam emitted by the laser source is deflected by the polygon mirror and transmitted through the fθ lens. After that, an optical path of the laser beam is turned back and bent down by the reflection mirrors. Thereby, each laser beam is rendered incident onto the surface of the photoconductive drum 26 of a corresponding one of the process cartridges 25K, 25Y, 25M, and 25C, such that the electrostatic latent image is formed on the surface of the photoconductive drum 26.

Subsequently, the fixing unit 70 of the laser printer 1 will be described. The fixing unit 70 is disposed in a downstream position on the feeding route R relative to the image forming unit 20 and the conveying unit 50 in the feeding direction. The fixing unit 70 fixes the toner image transferred on the sheet P by the image forming unit 20 and the conveying unit 50. As shown in FIG. 1, the fixing unit 70 includes a heating roller 71 and a pressing roller 72. The heating roller 71 is disposed at a side of an image-formed surface of the sheet P on which the toner image is formed. The heating roller 71 rotates in synchronization with the conveying belt 53 and feeds the sheet P while heating the toner transferred on the sheet P. The pressing roller 72 is disposed in a position to face the heating roller 71 across the sheet P. The pressing roller 72 is rotated in accordance with movement of the sheet P while pressing the sheet P against the heating roller 71. Thereby, the fixing unit 70 fixes onto the sheet P the toner transferred on the sheet P by heating the toner, and feeds the sheet P downstream in the feeding direction on the feeding route R.

The feeding route R is curved upward substantially in a U-shape in a downstream position relative to the fixing unit 70 in the feeding direction. Two ejection rollers are rotatably disposed just upstream relative to the catch tray 5 that is disposed in the most downstream position on the feeding route R. The ejection rollers 75 eject onto the catch tray 5 the sheet P fed via the fixing unit 70 with the image formed thereon, As shown in FIG. 1, the laser printer 1 includes the registration sensor unit 80 in a position, between a rear end of the conveying unit 50 and the fixing unit 70, which position is slightly lower than the sheet conveying surface 53A of the conveying unit 50, inside the main body housing 2. The registration sensor unit 80 is provided with registration sensors S and configured to detect detection patterns formed on the surface of the conveying belt 53 (on the side of the sheet conveying surface 53A) and transmit a detection signal to a controller (not shown) of the laser printer 1, as described below. Thereby, the laser printer 1 can correct a positional deviation and an inadequate density of each toner image that might be caused in image formation, when the controller thereof takes various kinds of control based on the result of the detection of the detection patterns with the registration sensors S. A configuration of the registration sensor 80 will be described in detail with reference to relevant drawings.

Subsequently, an explanation will be provided about operations to be performed for image formation in the laser printer 1. When performing an image forming operation, the laser printer 1 controls the image forming unit 20 to form a detection pattern with the toner of each color (each of black (K), yellow (Y), magenta (M), and cyan (C)) in predetermined positions (at both sides in a width direction of the conveying belt 53) on the surface of the conveying belt 53. After that, the laser printer 1 revolves the conveying belt 53 by driving the driving roller 51 to rotate, and detects the detection pattern of each toner color formed on the surface of the conveying belt 53 with the registration sensors S of the registration sensor unit 80. Then, the laser printer 1 corrects a positional deviation and an inadequate density of each toner image that might be caused in a subsequently-performed image forming operation, based on the result of the detection of the detection patterns with the registration sensors S.

When launching the image forming operation of forming an image on the sheet P, initially, the laser printer 1 drives the feeding unit 10 and the conveying unit 50 to convey the sheet P to the image forming unit 20. At that time, in the image forming unit 20, the surface of each photoconductive drum 26 is charged evenly and positively by the electrification device 27, and then exposed to the laser beam emitted by the scanning unit 60. Thereby, on the surface of each photoconductive drum 26, an electrostatic latent image (to be developed with toner of a corresponding one of the colors) is formed based on print data.

Due to the rotation of the supply roller 32 and the development roller 33, the toner in the toner container 31 is held and carried on the development roller 33. When the development roller 33 faces and contacts the photoconductive drum 26, the toner is supplied to the electrostatic latent image formed on the surface of the photoconductive drum 26. Thereby, the electrostatic latent image on the surface of the photoconductive drum 26 is rendered visible, and a toner image is carried in an inverted fashion on the surface of the photoconductive drum 26.

After that, the toner image carried on the surface of the photoconductive drum 26 is transferred onto the sheet P by a transfer voltage applied to the transfer roller 55. Then, when the sheet P with the toner image transferred thereon is fed to the fixing unit 70, the toner image is thermally fixed onto the sheet P by the heating roller 71 and the pressing roller 72. Finally, the sheet P with the image formed thereon is fed out of the fixing unit 70 and ejected onto the catch tray 5. Thus, the laser printer 1 ends the image forming operation.

Next, an explanation will be provided about operations of moving the drawer 40 of the laser printer 1 between the attachment position and the replacement position, with reference to the relevant drawings. As shown in FIG. 1, when the drawer 40 is located in the attachment position, the drawer 40 is substantially in a horizontal state above the conveying unit 50. At this time, each cam follower 44 disposed at an upper rear side of the drawer frame 41 is halted in contact with the stopper surface 3C of a corresponding one of the drawer guides 3. Further, when the drawer 40 is in the attachment position, each photoconductive drum 26 contacts the sheet conveying surface 53A of the conveying belt 53 and faces a corresponding one of the transfer rollers 55 across the conveying belt 53.

Further, as depicted in FIGS. 2 and 3, the drawer 40 can be pulled toward a front side of the main body housing 2 when the front cover 6 is open. A specific explanation will be provided about operations to be performed when the drawer 40 is moved from the attachment position (see FIG. 1) to the replacement position (see FIG. 3).

Initially, in the open state of the front cover 6, the user grips the front handle 42 and pulls the drawer 40 toward the front side of the main body housing 2. Thereby, each cam follower 44 rotates and moves obliquely upward along the second guide surface 3B. Accordingly, the drawer 40 is drawn obliquely upward along the second guide surface 3B. Consequently, the drawer 40 comes into a position higher than the attachment position (see FIG. 1), such that each photoconductive drum 26 is in a position higher than and obliquely away from a corresponding one of the transfer rollers 55 (see FIG. 2).

When the drawer 40 is pulled from the state as shown in FIG. 2 toward the front side of the main body housing 2, each cam follower 44 moves from the second guide surface 3B to the first guide surface 3A, and rotates and moves horizontally along the first guide surface 3A. Therefore, the drawer 40 is pulled out from the main body housing 2 horizontally along the first guide surface 3A (see FIG. 3). Then, the drawer 40 comes into the replacement position (see FIG. 3) when the cam follower 44 rotates and moves on the first guide surface 3A and at least one of the toner cartridges 30 (e.g., the toner cartridge 30K) comes into a position outside the main body housing 2. As illustrated in FIG. 3, when the drawer 40 is in the replacement position, the user is able to detach or attach a toner cartridge 30.

Subsequently, an explanation will be provided about operations to be performed when the drawer 40 is attached to the main body housing 2. When the drawer 40 is attached to the attachment position in the main body housing 2, the user places the cam follower 44 on the first guide surface 3A and inserts the drawer 40 toward a rear side of the main body housing 2. Thereby, the cam follower 44 rotates and moves horizontally along the first guide surface 3A, such that the drawer 40 moves horizontally along the first guide surface 3A.

Further, when the drawer 40 is inserted into a rear side in the main body housing 2, the cam follower 44 moves from the first guide surface 3A to the second guide surface 3B, and then rotates and moves obliquely downward along the second guide surface 3B. Thereafter, when moving along the second guide surface 3B, the cam follower 44 contacts the stopper surface 3C and halted thereby. At this time, the drawer 40 is supported to be kept horizontal in the attachment position such that the photoconductive drums 26 face the respective transfer rollers 55 across the conveying belt 53.

Thus, the laser printer 1 is configured such that the user can easily carry out maintenance for the process cartridges 25K, 25Y, 25M, and 25C provided to the drawer 40 and replacement of the toner cartridges 30K, 30Y, 30M, and 30C.

Next, a detailed explanation will be provided about a configuration of the registration sensor unit 80 of the first embodiment, with reference to the relevant drawings. As described above, the registration sensor unit 80 is configured to detect the detection pattern formed with each color of toner in the predetermined positions at both sides in a width direction of the conveying belt 53 on the surface of the conveying belt 53. Further, the registration sensor unit 80 includes the registration sensors S, a sensor case 81, protection films 82, a cover member 83, a biasing member 84, and an interlocking member 85 (see FIGS. 6 and 7).

The sensor case 81 has a long side that is slightly longer than a width of the conveying belt 53. The sensor case 81 is disposed in a predetermined position (see FIG. 1) inside the main body housing 2 such that the long side thereof is parallel to a width direction (the left-to-right direction) of the conveying belt 53. The sensor case 81 has an inclined surface extending from a side face of the sensor case 81 at a side near the conveying unit 50 toward an upper rear side of the main body housing 2.

On the inclined surface, the registration sensors S, each of which has the detection surface D, are disposed in respective two positions, corresponding to the positions where the detection patterns are formed, at both sides in the width direction of the conveying belt 53 (see FIG. 7). The detection surface D of each registration sensor S includes a detection section, which has a light emitting portion and a light receiving portion, and the protection film 82. Further, the detection surface D of each registration sensor S faces the surface of the conveying belt 53. The light emitting portion of the detection section of each registration sensor S is provided, e.g., with an light emitting diode (LED) and configured to emit light toward the surface of the conveying belt 53. The light receiving portion of the detection section of each registration sensor S is provided, e.g., with a phototransistor and configured to receive light reflected by the surface of the conveying belt 53. Hence, each registration sensor S detects the detection patterns formed on the surface of the conveying belt 53 by receiving, with the light receiving portion, the light emitted by the light emitting portion and then reflected by the surface of the conveying belt 53. Each protection film 82 is formed from a translucent (or transparent) film material and disposed in a position closer to the conveying belt 53 than the detection section so as to cover the detection section (see FIGS. 7 to 9B).

The cover member 83 includes cleaners 83A, a shaft 83B, and a projection 83C. The cover member 83 is supported to be rotatable around the shaft 83B between a first position and a second position. It is noted that the first position is a position where the cover member 83 covers the detection surface D of each registration sensor S (see FIGS. 6, 8B, and 9B). The second position is a position to which the cover member 83 is turned upward such that the detection surface D of each registration sensor S is exposed to face the surface of the conveying belt 53 (see FIGS. 7, 8A, and 9A).

Each cleaner 83A is configured with a sponge formed by foaming synthetic resin, and disposed on a surface, of the cover member 83, which faces a corresponding one of the detection surfaces D when the cover member 83 is in the first position. The cleaner 83A has a cleaning surface slightly larger than the detection surface D, so as to contact an entire area of the detection surface D when the cover member 83 is in the first position (see FIG. 9A). The cleaner 83A moves up and down in contact with the detection surface D, as the cover member 83 moves between the first position and the second position. Accordingly, the laser printer 1 can wipe a contamination (such as toner and paper dust) off the detection surface D when the cover member 83 moves between the first position and the second position.

The projection 83C is formed to protrude outward (in a rightward direction of the main body housing 2) in a predetermined position on a right side face of the cover member 83. The projection 83C causes the cover member 83 to turn and move from the first position to the second position while contacting the interlocking member 85.

The biasing member 84 is configured with a twist spring, and inserted in the shaft 83B. The biasing member 84 urges the cover member 83 in a direction from the second position to the first position by an elastic force of the biasing member 84.

The interlocking member 85 is formed substantially in a V-shape, and provided with a first contact portion 85A, a second contact portion 85B, and a rotational shaft 85C. The interlocking member 85 is supported at a bending point of its V-shape by the rotational shaft 85C, to be rotatable around the rotational shaft 85C on the right side face of the sensor case 81. The first contact portion 85A is located at a front side relative to the rotational shaft 85C (i.e., to be closer to the conveying unit 50 than the rotational shaft 85C) in the interlocking member 85. The first contact portion 85A contacts the contact member 47 of the operating member 45 when the drawer 40 is in the attachment position. The second contact portion 85B is located at a rear side relative to the rotational shaft 85C in the interlocking member 85. The second contact portion 85B contacts the projection 83C of the cover member 83. Accordingly, the laser printer 1 can move the cover member 83 between the first position and the second position in conjunction with the turning of the interlocking member 85.

Subsequently, a detailed explanation will be provided about an operation of cleaning the detection surface D in response to movement of the drawer 40 in the laser printer 1 of the first embodiment, with reference to FIGS. 8A, 8B, 9A and 9B. Firstly, a case where the drawer 40 moves from the attachment position to the replacement position will be described.

When the drawer 40 is in the attachment position, the contact member 47 of the operating member 45 contacts the first contact portion 85A of the interlocking member 85 from above. Thus, the gravity applied to elements such as the drawer 40 and each process cartridge 25 acts on the first contact portion 85A, and thereby the interlocking member 85 turns clockwise around the rotational shaft 85C and comes into such a position as shown in FIG. 8A. At this time, as the second contact portion 85B contacts the projection 83C of the cover member 83, the cover member 83 comes into the second position in conjunction with the turning of the interlocking member 85 (see FIG. 8A). Accordingly, when the drawer 40 is in the attachment position, the detection surface D of each registration sensor S is exposed to face the surface of the conveying belt 53 of the conveying unit 50 without being shielded by the cover member 83 (see FIG. 9A). Thereby, when the drawer 40 is in the attachment position to allow execution of image formation, the laser printer 1 can detect the detection patterns formed on the surface of the conveying belt 53 by the detection surface D of each registration sensor S, and thus correct a positional deviation and an inadequate density of each toner image based on the result of the detection of the detection patterns.

Next, an explanation will be provided about a case where the drawer 40 moves from the attachment position to the replacement position. As described above, when beginning to move from the attachment position, the drawer 40 is pulled along the second guide surfaces 3B while moving upward. Hence, the contact member 47 of the operating member 45 comes to be away from the first contact portion 85A of the interlocking member 85, in response to the movement of the drawer 40. Here, the cover member 83 is urged in the direction from the second position to the first position by the elastic force of the biasing member 84. When the operating member 45 is away from the first contact portion 85A, the force applied to the first contact portion 85A dissolves, such that the projection 83C of the cover member 83 pushes down the second contact portion 85B of the interlocking member 85 with the elastic force of the biasing member 84. Consequently, the cover member 83 turns around the shaft 83B from the second position to the first position (see FIG. 8B). When the cover member moves from the second position to the first position, each cleaner 83A moves down in contact with the detection surface D of a corresponding one of the registration sensors S (see FIG. 9B). Thereby, the laser printer 1 can clean the detection surfaces D of the registration sensors S with the cleaners 83A in response to the drawer 40 moving from the attachment position to the replacement position.

Further, when the cover member 83 is in the first position, the detection surfaces D of the registration sensors S are covered with the cover member 83 and the cleaners 83A (see FIG. 9B). Accordingly, even though toner and/or paper dust are splashed into the main body housing 2, the laser printer 1 can protect the detection surfaces D from the toner and/or the paper dust in response to the drawer 40 moving from the attachment position to the replacement position.

Subsequently, an explanation will be provided about a case where the drawer 40 moves from the replacement position to the attachment position. As described above, when the drawer 40 is in the replacement position, the cover member 83 is located in the first position to cover the detection surfaces D of the registration sensors S with the cleaners 83A (see FIGS. 8B and 9B). When moved from the replacement position to the attachment position, the drawer 40 moves down along the second guide surfaces 3B of the drawer guides 3. At this time, since the drawer 40 moves down along the second guide surfaces 3B, the contact member 47 certainly comes into contact with the first contact portion 85A of the interlocking member 85 from above.

When the contact member 47 contacts the first contact portion 85A, the gravity applied to elements containing the drawer 40 and each process cartridge 25 acts on the first contact portion 85A. At this time, the elastic force of the biasing member 84 acts on the second contact portion 85B of the interlocking member 85 via the projection 83C of the cover member 83. However, since the force applied by the operating member 45 is greater than the elastic force of the biasing member 84, the interlocking member 85 turns clockwise around the rotational shaft 85C. Then, in conjunction with the interlocking member 85 turning, the second contact portion 85B pushes up the projection 83C, such that the cover member 83 turns around the shaft 83 B from the first position to the second position (see FIG. 8A).

As mentioned above, when the cover member 83 is in the first position, each cleaner 83A contacts the detection surface D of a corresponding one of the registration sensors S (see FIG. 9B). Therefore, when the cover member 83 moves from the first position to the second position, the cleaner 83A moves downward in contact with the detection surface D of the registration sensor S. Thereby, the laser printer 1 can clean the detection surfaces D of the registration sensors S with the cleaners 83A in response to the movement of the drawer 40 from the replacement position to the attachment position.

As describe above, according to the laser printer 1 of the first embodiment, when the drawer 40 is moved between the attachment position and the replacement position, it is possible to move the cover member 83 between the first position and the second position by cooperation between the contact member 47 of the operating member 45 included in the drawer 40 and the biasing member 84 and the interlocking member 85 included in the registration sensor unit 80. The cover member 83 includes the cleaners 83A, which are provided to be able to contact with the detection surfaces D of the registration sensors S, respectively (see FIGS. 9A and 9B). Accordingly, in conjunction with the movement of the cover member 83 between the first position and the second position, the cleaners 83A move in contact with the detection surfaces D, so as to clean the detection surfaces D.

Namely, in response to the movement of the drawer 40 between the attachment position and the replacement position, the laser printer 1 can clean the detection surfaces D of the registration sensor unit 80 and keep clean the detection surfaces D that exert an influence on the reading accuracy for reading the detection patterns. Further, the drawer 40 is periodically moved between the attachment position and the replacement position, e.g., at the time for replacement of a toner cartridge 30. Therefore, the laser printer 1 can periodically clean the detection surfaces D and keep the detections surfaces D clean even though the user is not careful about cleaning the detection surfaces D. Consequently, the laser printer 1 can maintain a high level of detection accuracy for detecting the detection patterns with the registration sensor unit 80. Thus, it is possible to appropriately correct a positional deviation and an inadequate density of each toner image that might be caused in image formation and to maintain favorable image quality.

Further, in the laser printer 1, the attachment position of the drawer 40 is a position, lower than the replacement position, where the surface of each photoconductive drum 26 contacts the upper surface of the conveying belt 53 (see FIGS. 1 to 3). When moving from the replacement position to the attachment position, the drawer 40 moves obliquely downward along the second guide surfaces 3B to be in the attachment position. At this time, the gravity applied to elements containing the drawer 40 and each process cartridge 25 acts on the interlocking member 85. Thus, according to the laser printer 1, it is possible to certainly clean the detection surfaces D in response to the movement of the drawer 40 from the replacement position to the attachment position.

Further, each detection surface D is configured with the protection film 82 that is formed from a transparent film material and disposed to cover the detection section. Each cleaner 83A is provided to be able to contact the surface of the protection film 82. Accordingly, when the detection surfaces D is cleaned with the cleaners 83A, the laser printer 1 can prevent the detection section from being damaged by the cleaners 83A.

Further, in the laser printer 1, the registration sensor unit 80 is disposed in such a position as to be able to optically read the detection patterns formed on the surface of the conveying belt 53, at a rear side in the direction in which the drawer 40 moves from the replacement position to the attachment position in the main body housing 2 (see FIGS. 1 to 3). Namely, in the laser printer 1, the registration sensor unit 80 is disposed in such a position that a user's hand cannot reach there and the user can hardly clean the detection surfaces D. Even in such a case, the laser printer 1 can clean the detection surfaces D of the registration sensor unit 80 with the cleaners 83A in response to the movement of the drawer 40.

Second Embodiment

Subsequently, a second embodiment will be described with reference to FIG. 10. In the second embodiment, the basic configuration of the laser printer 1 is the same as that in the first embodiment. Therefore, an explanation about the basic configuration of the laser printer 1 will be omitted. The second embodiment is different from the first embodiment with respect to the configuration of the registration sensor unit 80. Hence, in the following description, a registration sensor unit 80 of the second embodiment will be described.

FIGS. 10A and 10B are front views showing a portion around a right end of the registration sensor unit 80 in the second embodiment. FIG. 10C is a top view of the registration sensor unit 80 in the second embodiment. A configuration of a portion around a left end of the registration sensor unit 80 is substantially the same as that around the right end, except for left-right reversal. Thus, in the following description, a portion around the right end of the registration sensor unit 80 will be described.

As illustrated in FIGS. 10A to 10C, the registration sensor unit 80 of the second embodiment includes the same registration sensors S, sensor case 81, and protection films 82 as exemplified in the first embodiment. Further, the registration sensor unit 80 of the second embodiment includes a slide cover member 86, and an interlocking mechanism 87, instead of the cover member 83, the biasing member 84, and the interlocking member 85 in the first embodiment.

The slide cover member 86 is disposed near the detection surface D of the registration sensor S, to be able to slide in the width direction (i.e., the left-to-right direction) along the inclined surface (see FIGS. 10A and 10B). The slide cover member 86 includes a cleaner 86A, an elongated hole 86B, and an elastic member 86C. In the slide cover member 86, the cleaner 86A is disposed on a surface that faces the detection surface D at an end near the center in the width direction. The cleaner 86A is configured with a sponge in the same manner as exemplified in the first embodiment, and a cleaning surface thereof is provided to be able to contact the detection surface D (see FIG. 10C). Accordingly, the laser printer 1 of the second embodiment can clean the detection surface D with the cleaner 86A in response to sliding movement of the slide cover member 86.

The elongated hole 86B is formed to be open in a position adjacent to the cleaner 86A at an end side of the sensor case 81 in the width direction. When the slide cover member 86 is made slide toward a central side of the sensor case 81 in the width direction, the detection surface D is exposed through the elongated hole 86AB so as to read the detection patterns (see FIG. 10B). The elastic member 86C is configured to, by its elastic force, return the slide cover member 86, which has been moved to the central side of the sensor case 81 in the width direction, to an initial position on an end side of the sensor case 81 in the width direction.

The interlocking mechanism 87 includes a drawer contact member 87A and a cover slide gear 87B. When the drawer 40 is in the attachment position, the drawer 87A is pushed down by the operating member 45. Further, the drawer contact member 87A is formed in a shape of a rack gear having teeth on a side face closer to the center of the sensor case 81 in the width direction (i.e., on a side face on the viewers' right hand in FIGS. 10A and 10B).

The cover slide gear 87B is rotatably disposed in a position closer to the center of the sensor case 81 in the width direction than the drawer contact member 87A, at an end side of the sensor case 81 in the width direction. The cover slide gear 87B includes a first gear section and a second gear section. The first gear section has teeth formed on a circumferential surface thereof to engage with the teeth formed on the side face of the drawer contact member 87A. The second gear section has teeth formed on a circumferential surface thereof to engage with up-facing teeth of the slide cover member 86 that are formed at an end of the slide cover member 86 in the width direction.

Subsequently, an explanation will be provided about an operation of cleaning the detection surface D in the second embodiment. Initially, a case where the drawer 40 moves from the replacement position to the attachment position will be described. In this case, the registration sensor unit 80 is in a state as shown in FIG. 10A until the drawer 40 reaches the attachment position. When the drawer 40 reaches the attachment position, the drawer contact member 87A is pushed down by the operating member 45. Thereby, the cover slide gear 87B is rotated counterclockwise, such that the slide cover member 86 moves toward the center of the sensor case 81 in the width direction. As depicted in FIGS. 10A and 10B, the cleaner 86A moves toward the center of the sensor case 81 in the width direction while contacting the detection surface D. Accordingly, in the second embodiment as well, the laser printer 1 can clean the detection surface D in response to the movement of the drawer 40. In addition, when the slide cover member 86 is located at the central side of the sensor case 81 in the width direction, the elongated hole 86B is located opposite the detection surface D. Thereby, as the detection surface D is exposed through the elongated hole 86B, the laser printer 1 can read the detection patterns formed on the conveying belt 53.

Next, an explanation will be provided about a case where the drawer 40 moves from the attachment position to the replacement position. In this case, since the drawer 40 is in the attachment position, the registration sensor unit 80 is in a state as shown in FIG. 10B. When the drawer 40 starts moving from the attachment position, the drawer contact member 87A is released from the force applied by the operating member 45. The elastic member 86C applies, to the slide cover member 86, an elastic force to urge the slide cover member 86 toward the end side of the sensor case 81 in the width direction. Hence, by the elastic force of the elastic member 86C, the slide cover member 86 is moved to slide toward the end side of the sensor case 81 in the width direction. As shown in FIGS. 10A and 10B, the cleaner 86A moves toward the end side of the sensor case 81 in the width direction while contacting the detection surface D. Accordingly, in the second embodiment as well, the laser printer 1 can clean the detection surface D in response to the movement of the drawer 40. When the slide cover member 86 moves toward the end side of the sensor case 81 in the width direction, the cover slide gear 87B rotates clockwise to move up the drawer contact member 87A. Thereby, when the drawer 40 comes in the attachment position again, the registration sensor unit 80 can carry out the aforementioned operation.

As described above, in the laser printer 1 of the second embodiment as well, the same effects as described in the first embodiment can be provided. Namely, the laser printer 1 of the second embodiment can as well clean the detection surface D of the registration sensor S with the cleaner 86A in conjunction with the movement of the drawer 40 from the replacement position to the attachment position.

Hereinabove, the embodiments according to aspects of the present invention have been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only exemplary embodiments of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications may be feasible.

In the aforementioned embodiments, a method to directly transfer the toner image from the photoconductive drums 26 onto the sheet P is applied. However, a method to transfer the toner image from the photoconductive drums 26 onto the sheet P indirectly via an intermediate transfer belt may be applied.

Further, in the aforementioned embodiments, each detection surface D is configured with the protection film 82. However, various transparent elements may be applied instead of the protection film 82. For instance, a cover glass may be applied instead of the protection film 82. Further, a brush may be applied instead of the cleaners 83A and 86A as exemplified in the aforementioned embodiment.

What is claimed is:

1. An image forming device comprising:

a main body housing;

a plurality of process cartridges each of which accommodates recording agent of a specific one of colors used for image formation;

a plurality of photoconductive drums each of which is configured such that an electrostatic latent image, to be developed with the recording agent of a specific one of the colors, is formed thereon;

a belt unit comprising an endless belt wound around a pair of rollers inside the main body housing, the endless belt being configured such that an up-facing side of an outer surface thereof extends and travels in a predetermined direction;

a drawer configured to hold the process cartridges and the photoconductive drums arranged along the predetermined direction above the belt unit, the drawer being movable between an attachment position where each photoconductive drum faces the up-facing side of the outer surface of the endless belt and a replacement position where at least one of the process cartridges is outside the main body housing;

a pattern forming unit configured to form, on the up-facing side of the outer surface of the endless belt, a detection pattern corresponding to each color of the recording agent used for image formation;

a detection sensor comprising a detection surface that faces the outer surface of the endless belt, the detection sensor being configured to read, through the detection surface, each detection pattern formed on the outer surface of the endless belt;

a cleaning unit comprising a cleaning surface configured to be able to contact and clean the detection surface of the detection sensor; and an interlocking mechanism that causes the cleaning unit to clean the detection surface of the detection sensor with the cleaning surface in conjunction with movement of the drawer between the attachment position and the replacement position, wherein the attachment position of the drawer is lower than the replacement position, wherein in the attachment position, each photoconductive drum contacts the up-facing side of the outer surface of the endless belt, and wherein the interlocking mechanism causes the cleaning unit to clean the detection surface of the detection sensor with the cleaning surface in response to the drawer moving down to the attachment position from the replacement position.

2. The image forming device according to claim 1, wherein the cleaning unit is movable between a first position where the cleaning surface covers and contacts the detection surface of the detection sensor and a second position where the detection surface is exposed to face the outer surface of the endless belt, wherein when the drawer is in the attachment position, the cleaning unit is in the second position, wherein when the drawer is in the replacement position, the cleaning unit is in the first position, and wherein in response to the drawer moving between the replacement position and the attachment position, the interlocking mechanism causes the cleaning unit to move between the first position and the second position and thereby clean the detection surface of the detection sensor with the cleaning surface.

3. The image forming device according to claim 1, wherein the detection sensor comprises a cover that is formed from a translucent material and configured to cover the detection surface, and wherein the cleaning unit is configured such that the cleaning surface thereof is able to contact the cover.

4. The image forming device according to claim 1, wherein the detection sensor is disposed at a far side in a direction in which the drawer moves from the replacement position to the attachment position, inside the main body housing, such that the detection sensor optically reads, through the detection surface, each detection pattern formed on the outer surface of the endless belt.

* * * * *